US009159290B2

(12) United States Patent
Huang et al.

(10) Patent No.: US 9,159,290 B2
(45) Date of Patent: Oct. 13, 2015

(54) DISPLAY APPARATUS

(71) Applicant: InnoLux Corporation, Miao-Li County (TW)

(72) Inventors: Ju-Lin Huang, Miao-Li County (TW); Chien-Hsueh Chiang, Miao-Li County (TW); Yu-Shiuan Lee, Miao-Li County (TW); Zen-Chieh Chang, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 58 days.

(21) Appl. No.: 14/174,137

(22) Filed: Feb. 6, 2014

(65) Prior Publication Data

US 2014/0253524 A1 Sep. 11, 2014

(30) Foreign Application Priority Data

Mar. 7, 2013 (TW) ..... 102108119 A

(51) Int. Cl.
*G09G 3/36* (2006.01)

(52) U.S. Cl.
CPC ..... *G09G 3/3677* (2013.01); *G09G 2310/0286* (2013.01); *G09G 2320/0214* (2013.01)

(58) Field of Classification Search
CPC ..... G09G 2310/08; G09G 2310/0286; G09G 2320/0214; G09G 2310/066; G06F 1/00
See application file for complete search history.

(56) References Cited

U.S. PATENT DOCUMENTS

2011/0210955 A1 * 9/2011 Chang et al. ..... 345/212

FOREIGN PATENT DOCUMENTS

TW 201214372 A1 4/2012

* cited by examiner

*Primary Examiner* — Michael Faragalla
(74) *Attorney, Agent, or Firm* — Muncy, Geissler, Olds & Lowe, P.C.

(57) ABSTRACT

A scan driving circuit of a display apparatus is electrically connected to the display panel through a plurality of scan lines and includes a plurality of stages of driving unit. The driving unit comprises a shift control device outputting a control signal according to a starting signal and a driving device. The driving device outputs an output signal to the corresponding scan line according to the control signal, a first trigger signal and a second trigger signal. The output signal is used as the starting signal of the next stage of driving unit, and the rising transition time of the second trigger signal and the falling transition time of the first trigger signal have an overlap.

13 Claims, 11 Drawing Sheets

DISPLAY APPARATUS

CROSS REFERENCE TO RELATED APPLICATIONS

This Non-provisional application claims priority under 35 U.S.C. §119(a) on Patent Application No(s). 102108119 filed in Taiwan, Republic of China on Mar. 7, 2013, the entire contents of which are hereby incorporated by reference.

BACKGROUND OF THE INVENTION

1. Field of Invention

The invention relates to a display apparatus and, in particular, to a flat display apparatus having a scan driving circuit.

2. Related Art

With the advantages such as low power consumption, less heat generation, lightness and less radiation, flat display apparatuses have been applied to various electronic products and gradually take the place of cathode ray tube (CRT) display apparatuses. Among the technologies of flat display apparatuses (e.g. LCD apparatus), the GOP (gate driver on panel) technology is used to form the components of the scan driver directly on the glass panel by a TFT (thin-film transistor) process, saving the cost of the scan driver IC. Currently, the GOP technology is mostly applied to the dual-sided driving display apparatus, which have two GOP circuits (i.e. scan driving circuits) on the left and right sides of the display area respectively lest the driving signals of the scan driving circuit of the single-sided large-scale display apparatus should diminish due to the higher resistance caused by the longer signal transmission distance.

FIG. 1 is a schematic block diagram of a conventional scan driving circuit 1 of a display apparatus. As shown in FIG. 1, the scan driving circuit 1 includes a clock generator CK, a first stage of driving unit 11, a second stage of driving unit 12, . . . , and an $m^{th}$ stage of driving unit 1*m*. The clock generator CK can alternately generate two clock signals CK1 and CK2. The clock signal CK1 leads the clock signal CK2 by a certain phase. The clock signals CK1 and CK2 are both inputted to the first stage of driving unit 11, second stage of driving unit 12, . . . , and $m^{th}$ stage of driving unit 1*m*. Besides, the first stage of driving unit 11 further receives an initial signal IN (such as a vertical synchronization signal, STV), and outputs an output signal $OUT_1$. The output signal $OUT_1$ can drive a row of pixel units and also can be used as the initial signal of the second stage of driving unit 12. In other words, the output signals of every stage of driving unit are used to be both of the driving signal of a row of pixel units and the initial signal of the next stage of driving unit. Thereby, an output signal $OUT_k$ ($1 \le k \le m$) can be sequentially outputted by the first stage of driving unit 11, second stage of driving unit 12, . . . , and $m^{th}$ stage of driving unit 1*m*, used as the scan signal of the display apparatus. The scan signal is inputted to the gate of the driving transistor (such as a TFT) of the pixel to turn on or turn off the driving transistor, and thereby the display apparatus can display images in cooperation with the input of the data signal.

FIGS. 2A and 2B are schematic waveform diagrams of the clock signals CK1 and CK2 in FIG. 1 and the output signal of $k^{th}$ stage of driving unit 1*k* ($1 \le k \le m$). To achieve the sufficient driving force, the last driving component (such as TFT) is usually configured with a considerably large size, and accordingly the accompanying parasitic capacitance (Cgd) is also considerably large. Therefore, as shown in FIG. 2, when the clock CK2 has a level transition (i.e. from a lower level to a higher lever or reversely), a rising or falling ripple (can be regarded as a noise) will be generated on the gate of the TFT due to the signal coupling effect. Moreover, a falling or rising ripple will be also generated on the gate of the TFT due to the signal coupling effect when the clock signal CK1 has a level transition. Besides, when the clock signal CK2 is changed from a lower level to a higher level, a current leakage path will formed in the last driving component (e.g. TFT), resulting in a larger ripple. Accordingly, for the conventional art, the falling ripple caused by the level transition of the clock signal CK1 decouples the rising ripple caused by the level transition of the clock signal CK2 during a data input period, and thereby the noise of the output signal $OUT_k$ at the timing t1, t2, t3, . . . in FIG. 2A is eliminated.

However, as shown in FIG. 2B, for a conventional display apparatus, the clock signal CK2 will not be counteracted by the clock signal CK1 of the previous phase during the beginning of the initial data input period Td or a blanking time Tb of every image because the clock signal CK1 doesn't appear thereat. Therefore, the output signal $OUT_k$ will have a high-level ripple voltage $V_p$, due to the signal coupling and current leakage effects caused by the level transition of the clock signal CK2, at the timing Tp1, Tp2, . . . as shown in FIG. 2B (i.e. the timing of the first appearing clock signal CK2 after the data input period begins and the timing within the blanking time Tb) after a frame time T of every image begins. Moreover, all the driving units 1*k* ($1 \le k \le m$) electrically connected to the clock signal CK2 will also be influenced likewise.

Accordingly, when the output signal $OUT_k$ with the high-level ripple voltage is inputted to the gate of the driving transistor, the levels of the gate and source of the driving transistor will be really close to each other, meaning the voltage difference (i.e. Vgs) becomes less. If the voltage difference between the gate and the source is greater than the threshold voltage (i.e. Vgs>Vth), the driving transistor will be turned on. Thus, the pixel voltage will be subjected to a current leakage, and accordingly the display apparatus will display erroneously (e.g. with bright or dark lines).

Therefore, it is an important subject to provide a display apparatus that can avoid the current leakage of the pixel voltage due to the signal coupling and current leakage effects and thus avoid erroneous display.

SUMMARY OF THE INVENTION

In view of the foregoing subject, an objective of the invention is to provide a display apparatus that can avoid the current leakage of the pixel voltage due to the signal coupling and current leakage effects and thus avoid erroneous display.

To achieve the above objective, a display apparatus according to the invention comprises a display panel, a data driving circuit and a scan driving circuit. The data driving circuit is electrically connected to the display panel through a plurality of data lines. The scan driving circuit is electrically connected to the display panel through a plurality of scan lines and includes a plurality of stages of driving unit, which are respectively corresponding to the scan lines. Each stage of driving unit comprises a shift control device outputting a control signal according to a starting signal and a driving device. The driving device is electrically connected to the shift control device and outputs an output signal to the corresponding scan line according to the control signal, a first trigger signal and a second trigger signal. The output signal is used as the starting signal of the next stage of driving unit. The rising transition time of the second trigger signal and the falling transition time of the first trigger signal have an overlap.

To achieve the above objective, a display apparatus according to the invention comprises a display panel, a data driving circuit and a scan driving circuit. The data driving circuit is electrically connected to the display panel through a plurality of data lines. The scan driving circuit is electrically connected to the display panel through a plurality of scan lines and includes a plurality of stages of driving unit, which are respectively corresponding to the scan lines. Each stage of driving unit comprises a shift control device, a driving device and a release device. The shift control device outputs a control signal according to a starting signal. The driving device is electrically connected to the shift control device and outputs an output signal to the corresponding scan line according to the control signal, a first trigger signal and a second trigger signal. The release device is electrically connected to the driving device and controlled by a release signal to release the electric energy of the control signal or output signal.

As mentioned above, in the display apparatus of the invention, the rising transition time of the second trigger signal overlaps the falling transition time of the first trigger signal, or the release device is controlled by the release signal to release the electric energy of the control signal or output signal. Thereby, within the beginning and blanking time of the frame time of every image, the high-level noise of the second trigger signal caused by coupling and current leakage effects can be eliminated. Or, the release device is turned on by the release signal to release the high-level ripple noise of the control signal (inputted to the driving device) or output signal. Therefore, the voltage difference between the gate and source of the driving transistor on the display panel will not be greater than the threshold voltage of the driving transistor so that the display apparatus can avoid the current leakage problem of the pixel voltage and thus avoid erroneous display (e.g. with bright or dark lines).

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 3:
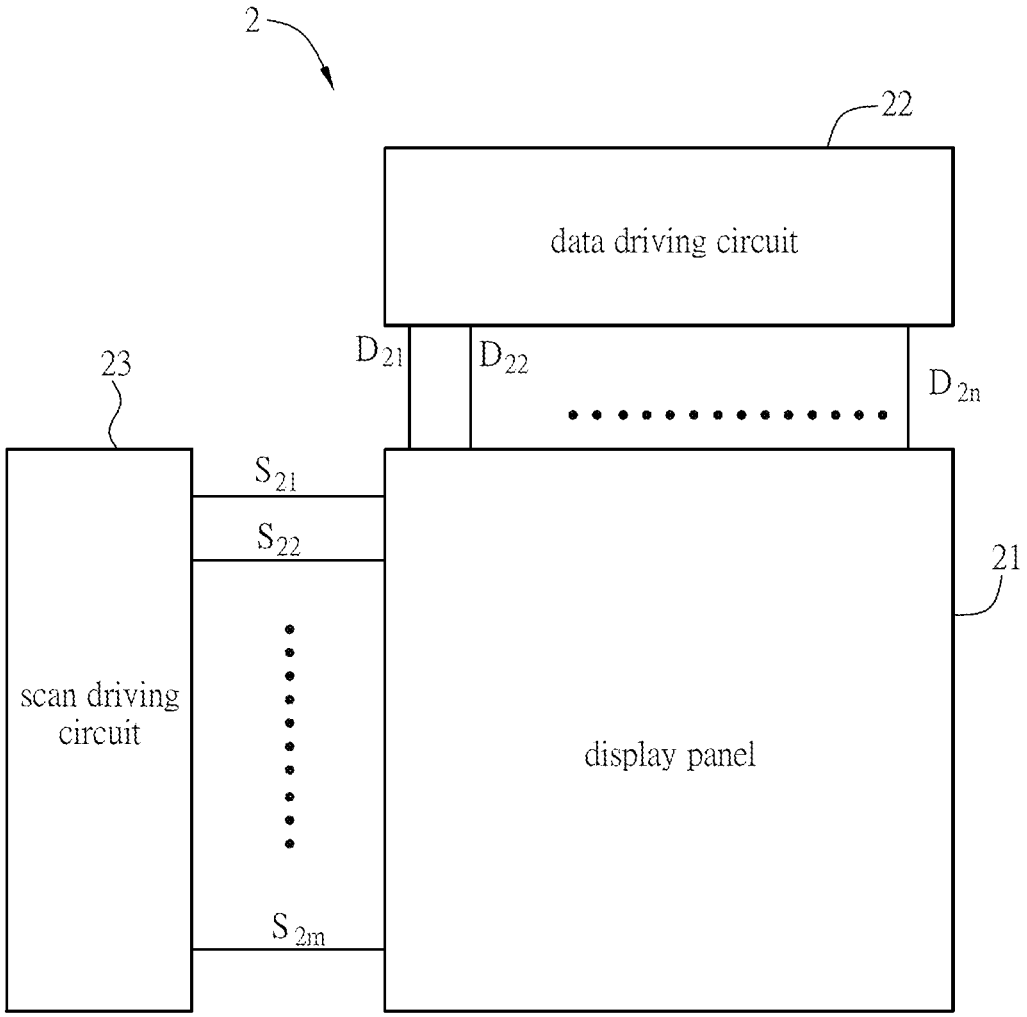
FIG. 3 is a schematic diagram of a display apparatus according to a first embodiment of the invention.

FIG. 3 is a schematic diagram of a display apparatus 2 according to a first embodiment of the invention.

The display apparatus 2 includes a display panel 21, a data driving circuit 22 and a scan driving circuit 23. The display panel 21 can be a liquid crystal display (LCD) panel, an organic electro-luminescence display (OELD) panel, a light emitting diode (LED) display panel or other kinds of flat display panels. The data driving circuit 22 is electrically connected to the display panel 21 through a plurality of data lines $D_{21}$~$D_{2n}$, and the scan driving circuit 23 is electrically connected to the display panel 21 through a plurality of scan lines $S_{21}$~$S_{2m}$. The scan driving circuit 23 includes a plurality of stages of driving unit (m stages here for example), and the stages of driving unit are corresponding to the scan lines respectively. In other words, every stage of driving unit is cooperated with a corresponding scan line to output the driving signal to drive the scan line. Besides, the display apparatus 2 can further include a timing control circuit (not shown), which can transmit the vertical clock signal and vertical synchronization signal to the scan driving circuit 23, and convert the outside video signals into the data signals to be used by the data driving circuit 22 and then transmit the data signals, horizontal clock signal and horizontal synchronization signal to the data driving circuit 22. Moreover, the scan driving circuit 23 sequentially enables the scan lines $S_{21}$~$S_{2m}$ according to the vertical synchronization signal. When the scan lines $S_{21}$~$S_{2m}$ are sequentially enabled, the data driving circuit 22 transmits the pixel voltage signals corresponding to each row of pixel units to the pixel electrode of each of the pixel units through the data lines, and thus the display apparatus 2 can display an image.

Figure 4A:
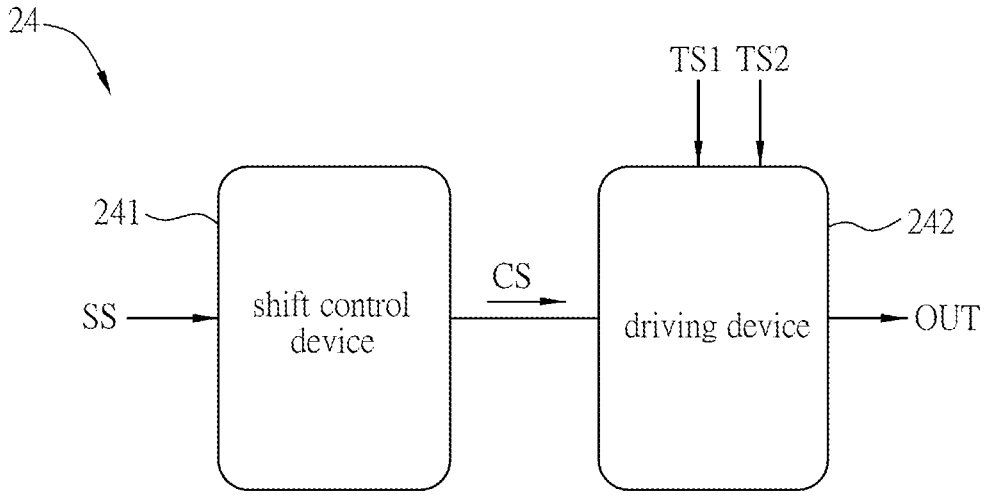
FIG. 4A is a schematic block diagram of one of the stages of driving unit of the scan driving circuit according to the first embodiment of the invention.

FIG. 4A is a schematic block diagram of one of the stages of driving unit 24 of the scan driving circuit 23 according to the first embodiment of the invention.

As shown in FIG. 4A, each of the stages of driving unit 24 of the scan driving circuit 23 has a shift control device 241 and a driving device 242. The shift control device 241 receives a starting signal SS, and outputs a control signal CS according to the starting signal SS. The shift control device 241 can include a pull-up and/or pull-down control circuit (not shown). Herein, the pull-up control circuit is used to receive the starting signal SS of the previous stage to trigger the output signal of the current stage, and the pull-down control circuit is used to keep the stability of the output signal of the driving unit 24.

The driving device 242 is electrically connected to the shift control device 241. The driving device 242 receives the control signal CS outputted by the shift control device 241, a first trigger signal TS1 and a second trigger signal TS2, and outputs an output signal OUT, according to the control signal CS, first trigger signal TS1 and second trigger signal TS2, to the corresponding scan line. Herein, the output signal OUT is the scan signal of the scan line corresponding of the driving unit 24. Besides, the output signal OUT is also used as the starting signal SS of the next stage of driving unit 24. In other words, the next stage of driving unit 24 will not be enabled to output the output signal until the current stage of driving unit 24 outputs the output signal OUT. Thereby, the driving units 24 can sequentially output the output signals OUT to enable the scan lines $S_{21}$~$S_{2m}$. To be noted, for the first stage of driving unit 24, the starting signal SS is, for example, the vertical synchronization signal (STV) outputted by the timing control circuit.

Figure 4B:
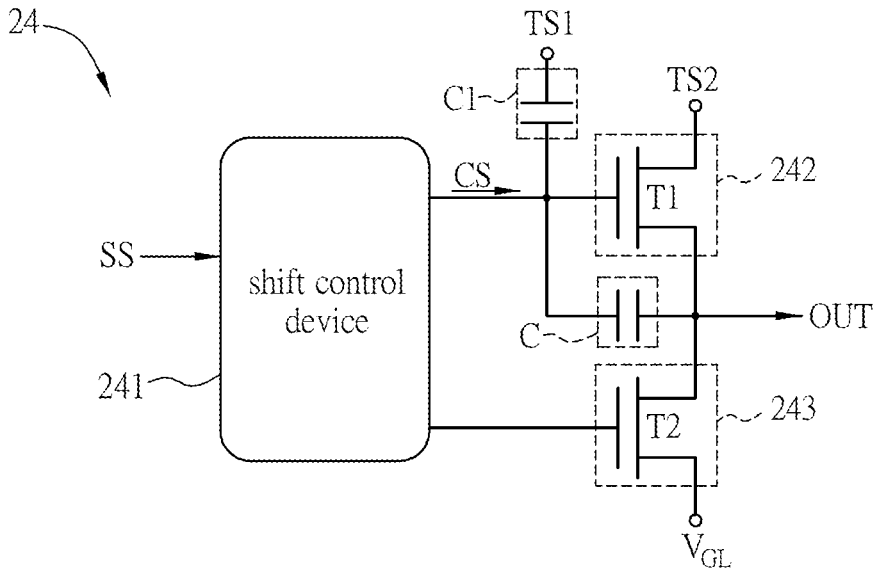
FIG. 4B is a schematic circuit diagram of the driving unit in FIG. 4A.
Figure 4C:
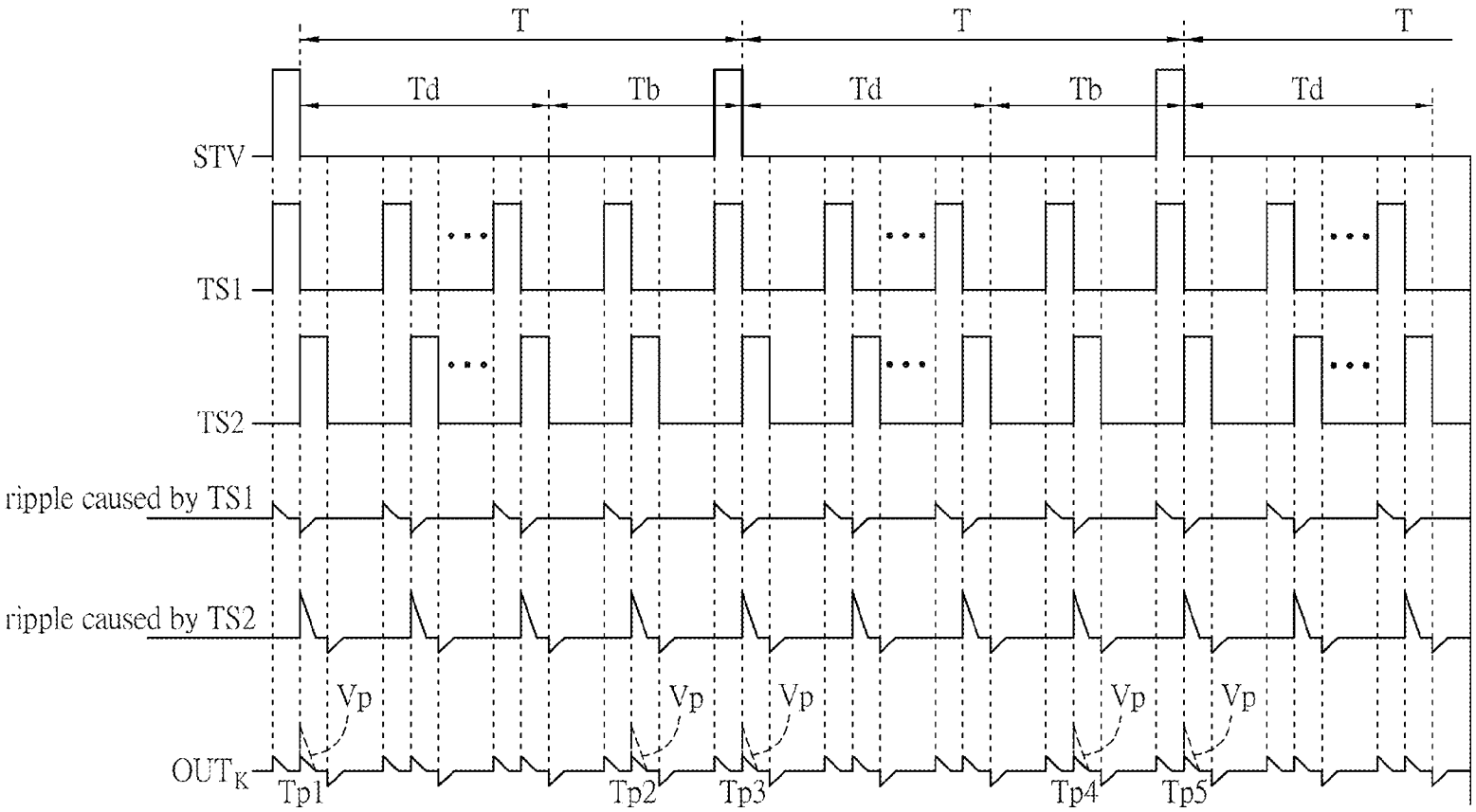
FIG. 4C is a schematic waveform diagram of the first trigger signal, second trigger signal and output signal in FIG. 4A.

FIGS. 4C is a schematic waveform diagram of the first trigger signal TS1, second trigger signal TS2 and output signal OUT in FIG. 4A.

As shown in FIG. 4C, a frame time T includes a data output time Td and a blanking time Tb. The display panel 21 outputs a frame data within the data output time Td, and the blanking time Tb is the interval between two consecutive data output times Td. That is, the display panel 21 doesn't output the frame data during the blanking time Tb. In other words, the blanking time Tb is after a scan cycle where the all scan lines $S_{21}$~$S_{2m}$ sequentially output the output signals (scan signals) OUT and before the next scan cycle. Herein, the first trigger signal TS1 and the second trigger signal TS2 can be a pulse signal (such as a clock signal) each, including a plurality of pulses.

Figure 4D:
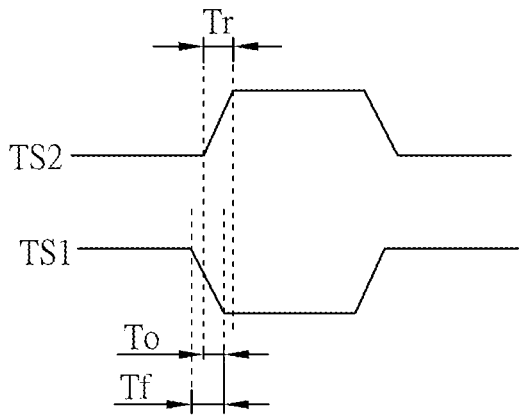
FIG. 4D is a schematic diagram of the overlap between the rising transition time of the second trigger signal and the falling transition time of the first trigger signal according to the invention.

The rising transition time (i.e. from a lower level to a higher level) of the second trigger signal TS2 overlaps the falling transition time (i.e. from a higher level to a lower level) of the first trigger signal TS1. In this embodiment, the overlap is within the first pulse of the second trigger signal TS2 (i.e. the second trigger signal TS2 that first appears) after the data output time Td begins and within the blanking time Tb. Herein as shown in FIG. 4D for explaining the above-mentioned "overlap", the second trigger signal TS2 has a rising transition time Tr (also has a falling transition time of course), the first trigger signal TS1 has a falling transition time Tf (also has a rising transition time of course), and the rising transition time Tr of the second trigger signal TS2 and the falling transition time Tf of the first trigger signal TS1 have an overlap, denoted by the overlap time To in FIG. 4D for example. Preferably, the rising transition time Tr of the second trigger signal TS2 and the falling transition time Tf of the first trigger signal TS1 completely overlap. To be noted, for simplifying FIG. 4C, the rising transition time Tr of the second trigger signal TS2 and the falling transition time Tf of the first trigger signal TS1 are not shown in FIG. 4C.

FIG. 4B is a schematic circuit diagram of the driving unit 24 in FIG. 4A.

As shown in FIG. 4B, the driving device 242 includes a first transistor T1. The control terminal of the first transistor T1 is electrically connected to the shift control device 241, the first terminal thereof is used to receive the second trigger signal TS2, and the second terminal thereof outputs the output signal OUT. Herein, the control terminal of the first transistor T1 is the gate of the first transistor T1, which can receive the control signal CS outputted by the shift control device 241. The second terminal of the first transistor T1 also can be called the output terminal of the driving unit 24 to output the output signal OUT. When the shift control device 241 outputs the control signal CS to turn on the first transistor T1, the second trigger signal TS2 can be transmitted to the second terminal (output terminal) of the first transistor T1 for the output of the output signal OUT. The first trigger signal TS1 is electrically connected to the control terminal of the first transistor T1 through a capacitance C1.

The driving unit 24 further includes a pull-down device 243, which is electrically connected to the shift control device 241 and the driving device 242. Herein, the pull-down device 243 includes a second transistor T2. The control terminal (gate) of the second transistor T2 is electrically connected to the shift control device 241, the first terminal thereof is electrically connected to the second terminal of the first transistor T1, and the second terminal thereof is electrically connected to a reference voltage (low level $V_{GL}$ for example). The control terminal of the second transistor T2 is controlled by the shift control device 241 to turn on the second transistor T2. The second transistor T2 is a pull-down transistor, and can be controlled by the output signal of the next stage (not shown) to force the release of the output signal OUT that will be inputted to the current stage, for keeping the stability of the output signal OUT. In detail, when the output signal OUT of the next stage is outputted, the voltage of the output signal OUT of the previous stage will be pulled down to the reference voltage, so that the level of the output signal OUT of the previous stage is equal to the reference voltage, and thus the output signal of the previous stage is kept stable. Besides, the driving unit 24 can further include a capacitance C. The first terminal of the capacitance C is electrically connected to the control terminal of the first transistor T1, and the second terminal of the capacitance C is electrically connected to the second terminal of the first transistor T1 and the first terminal of the second transistor T2.

Figure 1:
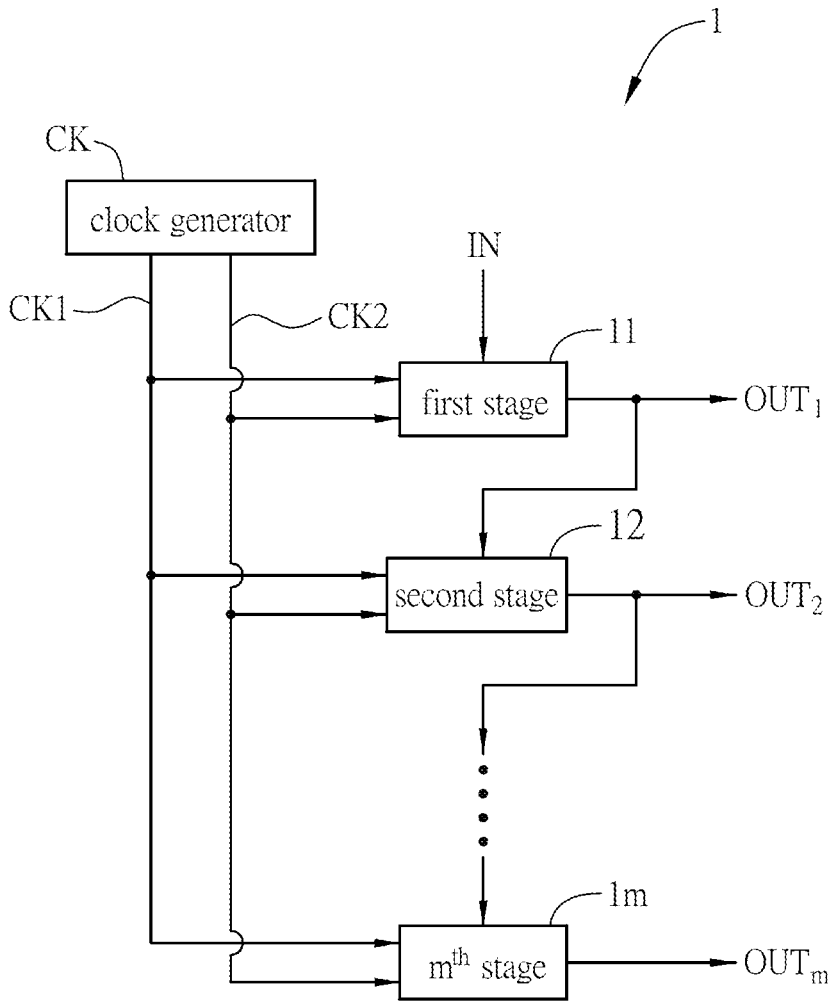
FIG.1 (Prior Art)
FIG. 1 is a schematic block diagram of a conventional scan driving circuit of a display apparatus.
Figure 2A:
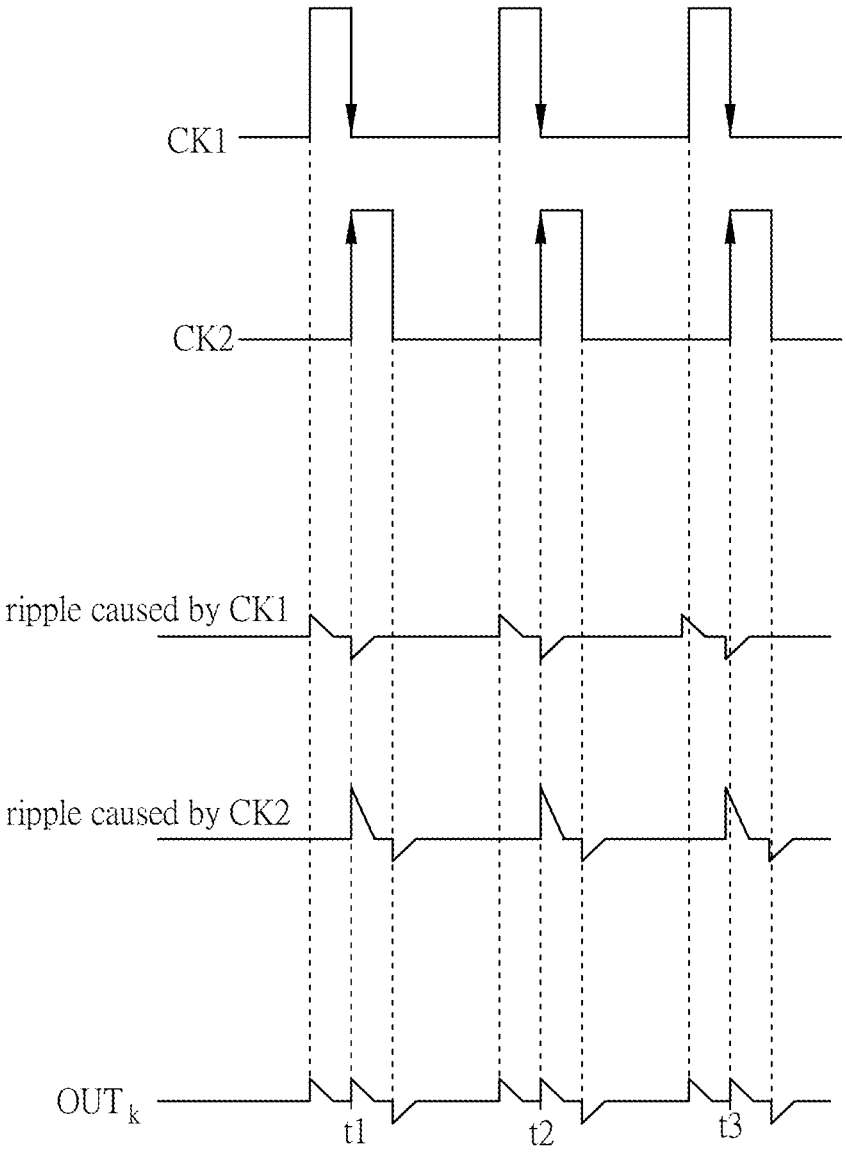
FIG.2A (Prior Art)
FIGS. 2A and 2B are schematic waveform diagrams of the clock signals in FIG. 1 and the output signal of $k^{th}$ stage of driving unit.
Figure 2B:
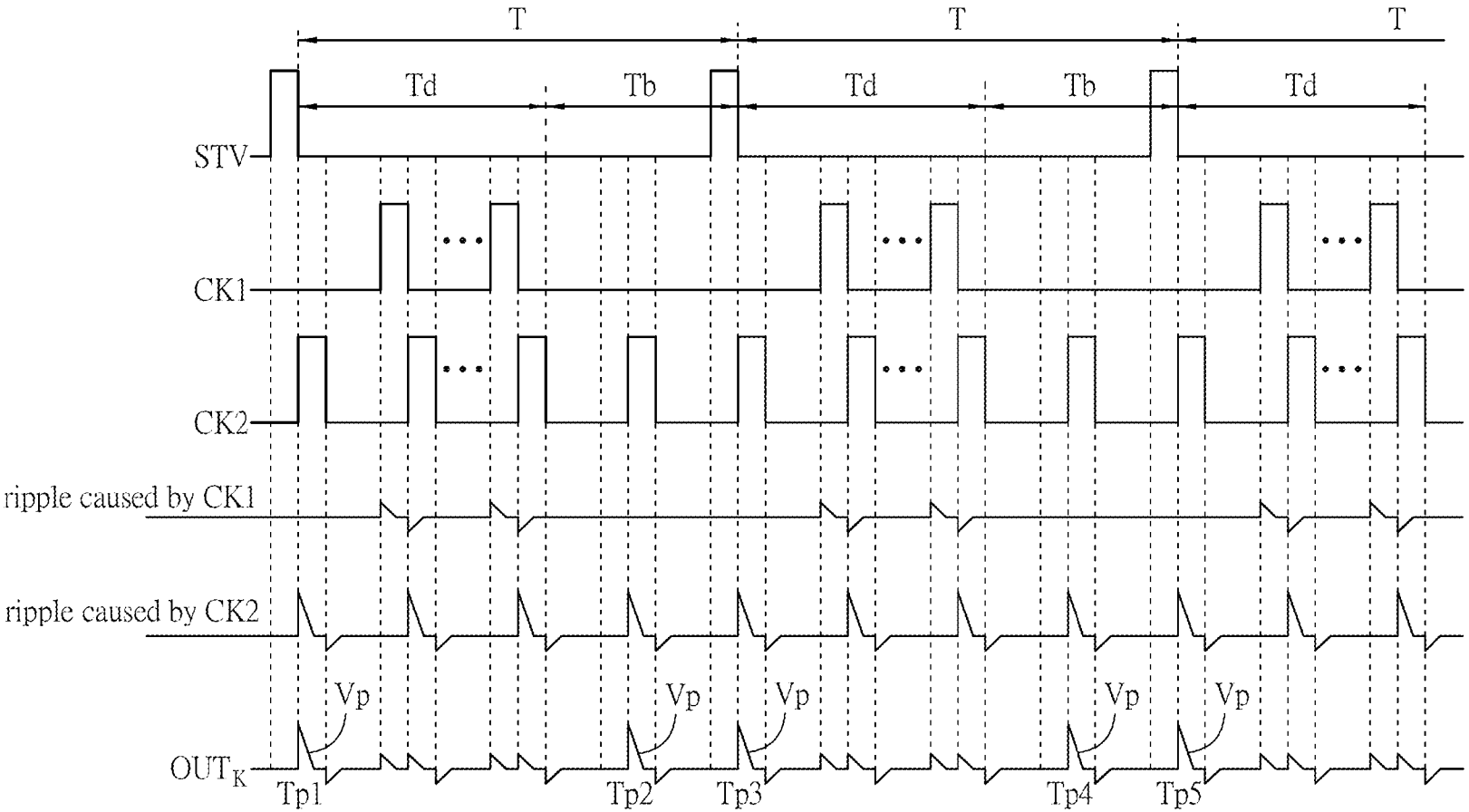
FIG.2B (Prior Art)

As shown in FIG. 4C, because the rising transition time of the second trigger signal TS2, within the first pulse of the second trigger signal TS2 after the data output time Td begins and within the blanking time Tb, overlaps the falling transition time of the first trigger signal TS1 (in the conventional art, the rising transition time of the second trigger signal TS2 (such as the clock signal CK2 in FIG. 2B), within the first pulse of the second trigger signal TS2 after the data output time Td begins and within the blanking time Tb, doesn't overlap the falling transition time of the first trigger signal TS1 (such as the clock signal CK1 in FIG. 2B)), the ripple caused by the second appearing trigger signal (such as the second trigger signal TS2) after the blanking time Tb of every image begins is reduced by the counteraction between the consecutive trigger signals (such as the first trigger signal TS1 and the second trigger signal TS2). Therefore, at the timing Tp1, Tp2, Tp3, . . . in FIG. 4C, the high-level noise Vp (denoted by the dotted line) caused by the coupling effect of the second trigger signal TS2 can be eliminated by the counteraction provided by the first trigger signal TS1 leading the second trigger signal TS2 by a certain phase. Thereby, the voltage difference between the gate and source of the driving transistor on the display panel 21 will not be greater than the threshold voltage of the driving transistor so that the display apparatus 2 can avoid the current leakage problem of the pixel voltage and thus avoid erroneous display.

Figure 4E:
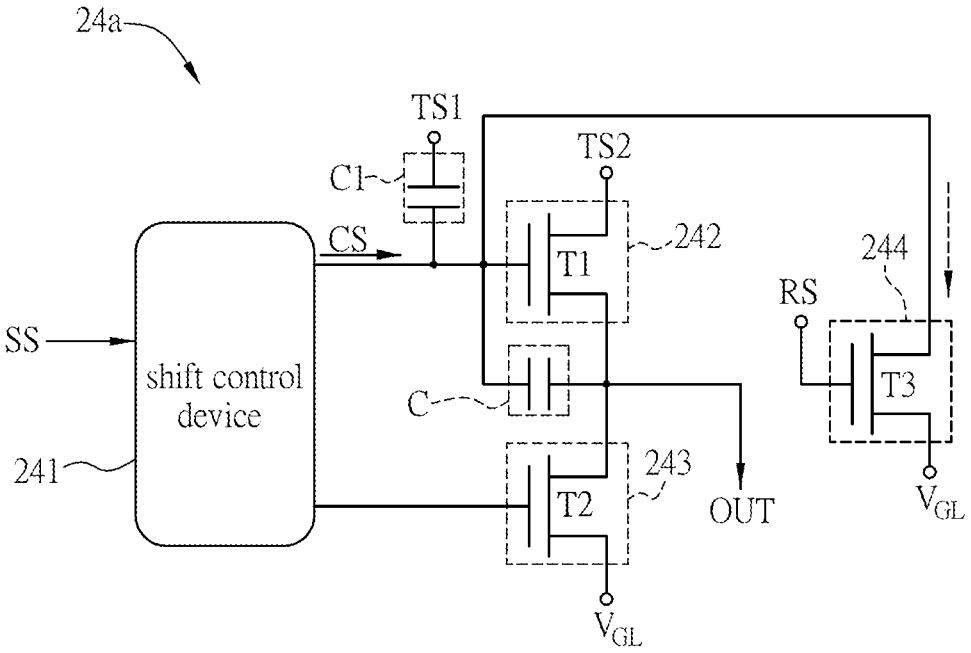
FIG. 4E is a schematic circuit diagram of a driving unit as an variation of the first embodiment of the invention.

FIG. 4E is a schematic circuit diagram of a driving unit 24*a* as an variation of the first embodiment of the invention.

Mainly different from the driving unit 24 in FIG. 4B, the driving unit 24*a* further includes a release device 244. The release device 244 is electrically connected to the driving device 242 and receives a release signal RS to release the electric energy of the control signal CS or output signal OUT. In this embodiment, the release device 244 is electrically connected to the shift control device 241 and the control terminal of the driving device 242, and is controlled by the release signal RS to release the electric energy of the control signal CS. The release device 244 includes a third transistor T3. The control terminal (gate) of the third transistor T3 receives the release signal RS, the first terminal thereof is electrically connected to the control terminal of the first transistor T1, and the second terminal thereof is electrically connected to the reference voltage (the low level voltage $V_{GL}$). As shown in FIG. 4C, if the high-level ripple noise of the control signal CS occurs at the first appearing trigger signal (the first trigger signal TS1 for example) in every frame time T, the vertical synchronization signal STV outputted by the timing control circuit can be used as the release signal RS to turn on the release device 244 to release the high-level ripple noise of the control signal CS. Furthermore, if the control signal CS has high-level ripple noise within the blanking time Tb of the frame time T, the release device 244 can be turned on by receiving a high-level release signal RS to release the high-level ripple noise of the control signal CS (to be noted, when the control signal CS has no high-level ripple noise, neither does the output signal OUT). Thereby, the voltage difference between the gate and source of the driving transistor on the display panel 21 will not be greater than the threshold voltage of the driving transistor so that the display apparatus 2 can avoid the current leakage problem of the pixel voltage and thus avoid erroneous display.

In other embodiments (not shown), the first terminal of the third transistor T3 can be electrically connected to the second terminal (i.e. the output terminal) of the first transistor T1, and the second terminal of the third transistor T3 is electrically connected to the reference voltage. Accordingly, when the third transistor T3 is turned on by receiving the release signal RS, the high-level ripple noise of the output signal OUT can be released through the third transistor T3, and thus the erroneous display can be avoided.

Figure 4F:
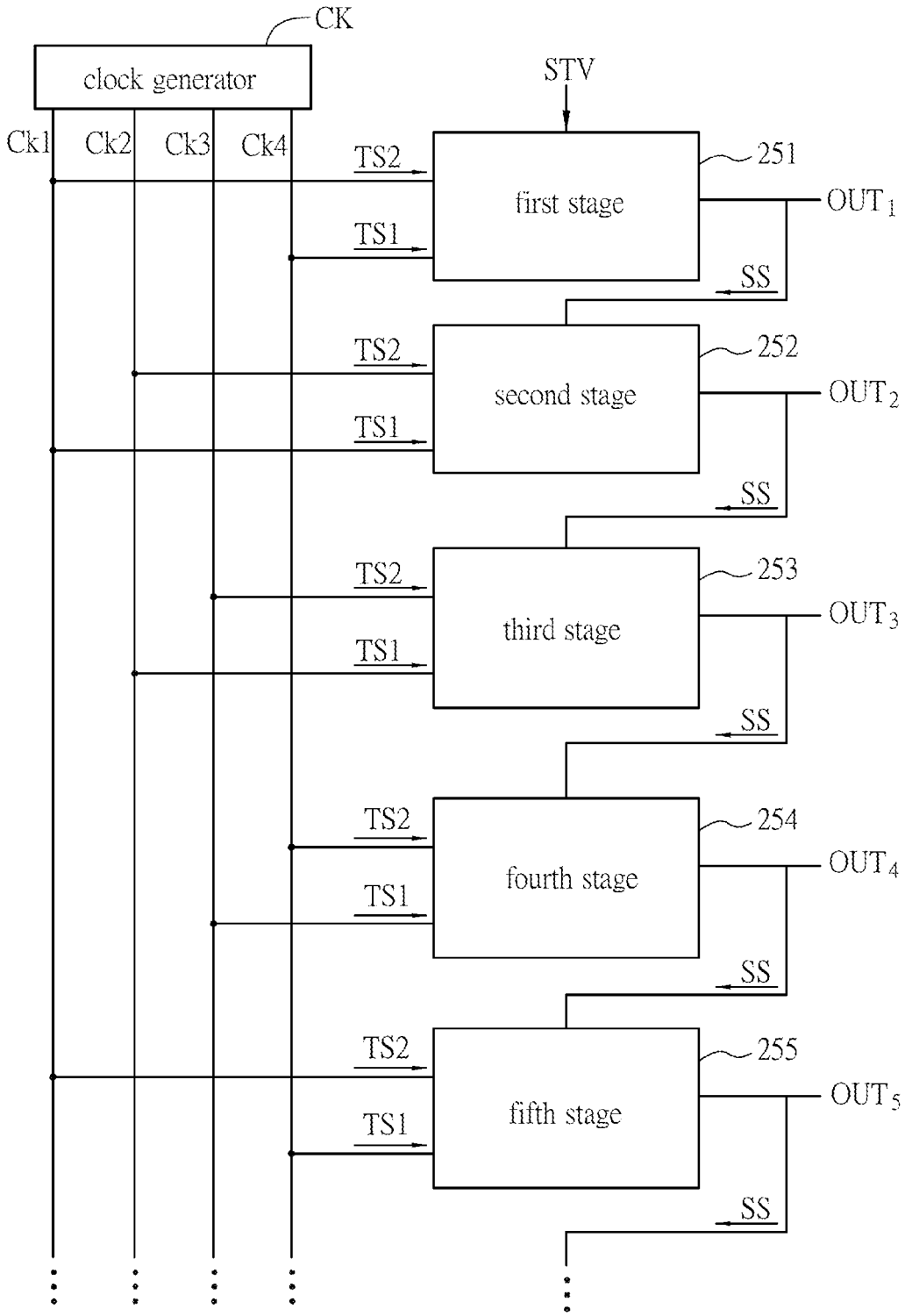
FIG. 4F is a schematic diagram of a partial structure of the clock generator and scan driving circuit according to the invention.

FIG. 4F is a schematic diagram of a partial structure of the clock generator and scan driving circuit according to the invention. As shown in FIG. 4F, the display apparatus 2 can further include a clock generator CK, which is electrically connected to every stage of driving unit 1*k* ($1 \le k \le m$) and generates a plurality of clock signals (which are periodic continuous signals respectively). Although just five stages of driving unit are shown in FIG. 4F, those skilled in the art can comprehend the whole connection of the scan driving circuit 23 and the clock generator CK thereby.

In this embodiment, the clock generator CK generates four clock signals CK1~CK4 and outputs them to the stages of driving unit. At least some of the clock signals CK1~CK4 can be used as the first trigger signal TS1 and the second trigger signal TS2. Physically, the driving units in FIG. 4F are called, from top to bottom, the first stage of driving unit 251, the second stage of driving unit 252, . . . , and the fifth stage of driving unit 255. The clock signal CK1 is the second trigger signal TS2 of the first stage of driving unit 251, and the clock signal CK4 is the first trigger signal TS1 of the first stage of driving unit 251. The clock signal CK2 is the second trigger signal TS2 of the second stage of driving unit 252, and the clock signal CK1 is the first trigger signal TS1 of the second stage of driving unit 252. The clock signal CK3 is the second trigger signal TS2 of the third stage of driving unit 253, and the clock signal CK2 is the first trigger signal TS1 of the third stage of driving unit 253. The clock signal CK4 is the second trigger signal TS2 of the fourth stage of driving unit 254, and the clock signal CK3 is the first trigger signal TS1 of the fourth stage of driving unit 254. The clock signal CK1 is the second trigger signal TS2 of the fifth stage of driving unit 255, and the clock signal CK4 is the first trigger signal TS1 of the fifth stage of driving unit 251. The rest can be deduced by analogy.

The clock signal CK1 is the first clock signal that the clock generator CK generates and is the second trigger signal TS2 of the first stage of driving unit 251, and the clock signal CK4 is the fourth clock signal that the clock generator CK generates and is the first trigger signal TS1 of the first stage of driving unit 251. Because the first and second trigger signals TS1 and TS2 are periodic continuous signals respectively and out of phase by a phase, the clock signals CK1 and CK4 are also periodic continuous signals respectively and out of phase by a phase. Thereby, as shown in FIG. 4C, the coupling effect caused by the level transition of the clock signal CK4 (the first trigger signal TS1) can be used to counteract the rising ripple caused by the level transition (especially the first level transition from a lower level to a higher level after the data output time begins and the level transition from a lower level to a higher level within the blanking time) of the clock signal CK1 (the second trigger signal), and thus the ripple of the output signal $OUT_1$ can be neutralized.

To be noted, the number of clock signals that the clock generator CK can generate is not limited in the invention as long as the level transition of the last clock signal can counteract the ripple caused by the level transition of the first clock signal and can counteract the ripple caused by the level transition of the first clock signal within the blanking time. Besides, the first and second trigger signals TS1 and TS2 don't necessarily come from the clock generator CK. They can be generated by other control circuits as long as they are pulse signals and the rising transition time of the first pulse of the second trigger signal TS2 after the data output time Td begins and that of the second trigger signal TS2 within the blanking time Tb both overlap the falling transition time of the first trigger signal TS1.

Figure 5:
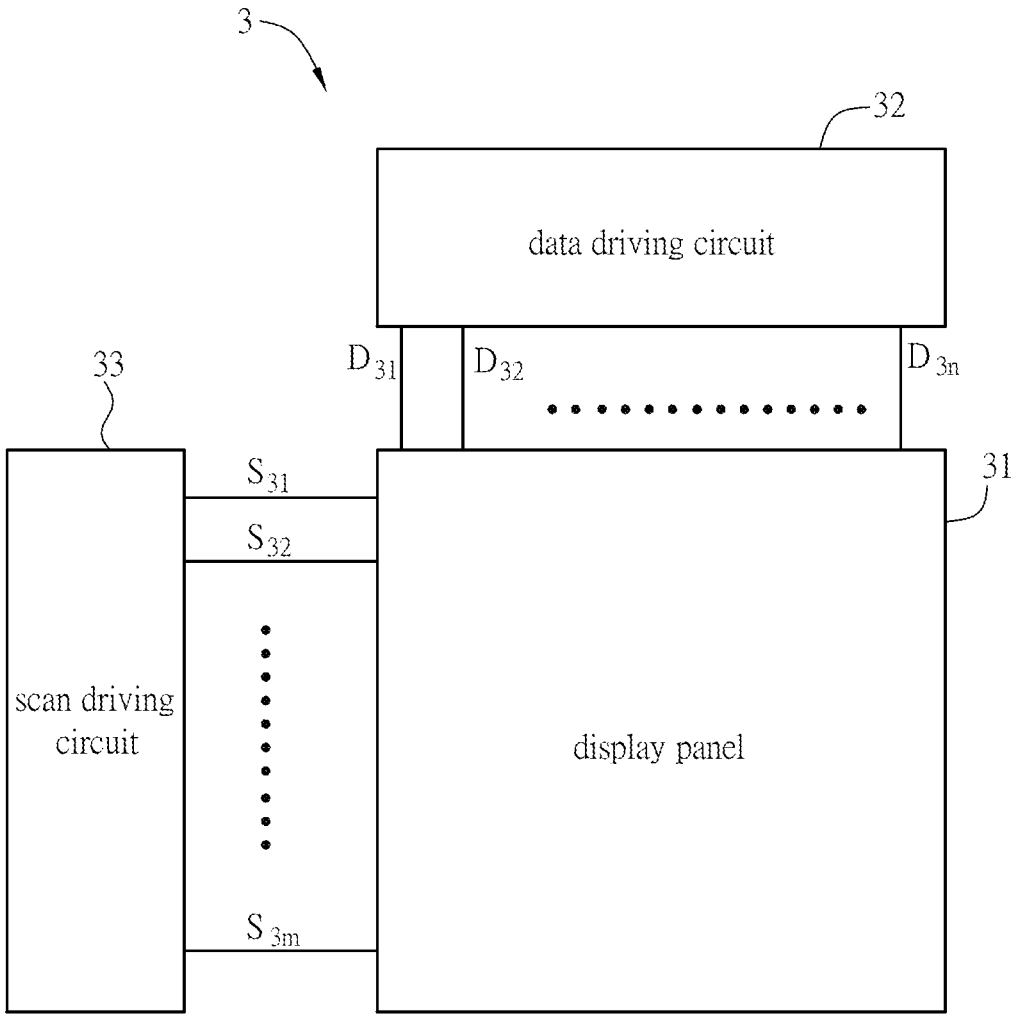
FIG. 5 is a schematic diagram of a display apparatus according to the second embodiment of the invention.
Figure 6A:
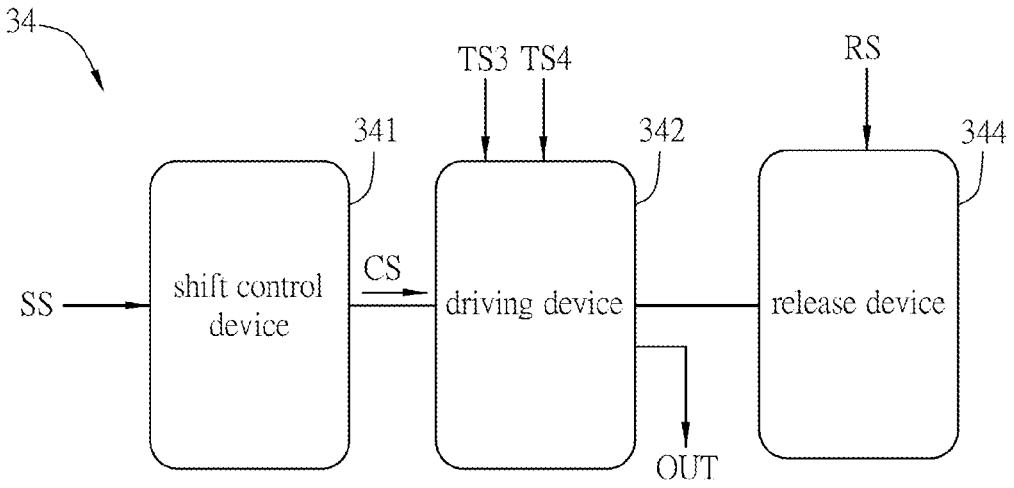
FIG. 6A is a schematic block diagram of a driving unit of the scan driving circuit in FIG. 5.
Figure 6B:
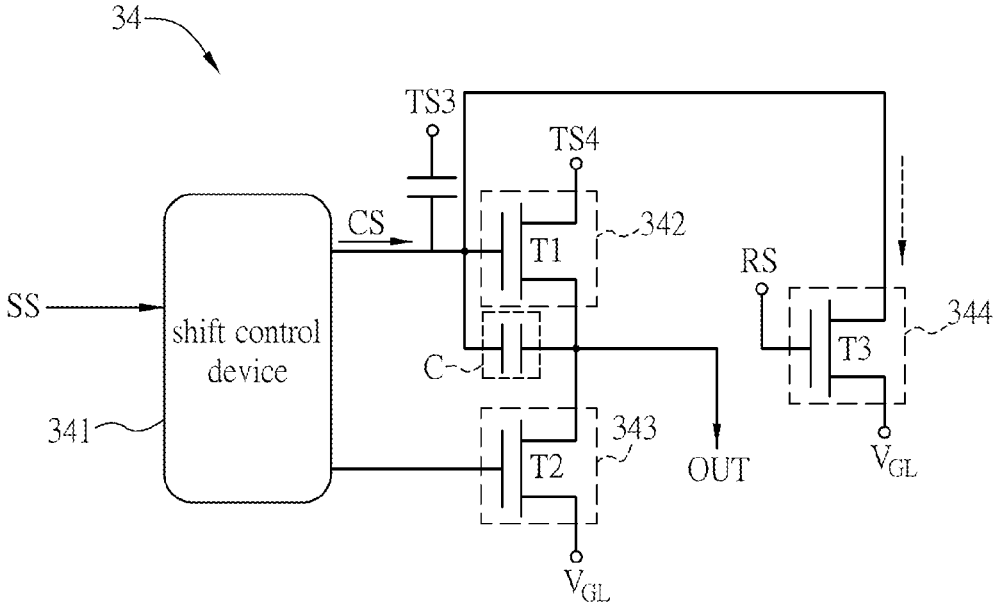
FIG. 6B is a schematic circuit diagram of the driving unit in FIG. 6A.

FIG. 5 is a schematic diagram of a display apparatus 3 according to the second embodiment of the invention, FIG. 6A is a schematic block diagram of a driving unit 34 of the scan driving circuit 33 in FIG. 5, and FIG. 6B is a schematic circuit diagram of the driving unit 34 in FIG. 6A.

As shown in FIG. 5, the display apparatus 3 includes a display panel 31, a data driving circuit 32 and a scan driving circuit 33. The data driving circuit 32 is electrically connected to the display panel 31 through a plurality of data lines $D_{31}$~$D_{3n}$, and the scan driving circuit 33 is electrically connected to the display panel 31 through a plurality of scan lines $S_{31}$~$S_{3m}$. The scan driving circuit 33 includes a plurality of stages of driving unit 34, and the stages of driving unit 34 are corresponding to the scan lines respectively. When the scan driving circuit 33 sequentially enables the scan lines $S_{31}$~$S_{3m}$, the data driving circuit 32 transmits the pixel voltage signals corresponding to each row of pixel units to the pixel electrode of each of the pixel units through the data lines, and thus the display apparatus 3 can display images.

As shown in FIG. 6A, each stage of driving unit 34 includes a shift control device 341, a driving device 342 and a release device 344. The shift control device 341 outputs a control signal CS according to a starting signal SS. The driving device 342 is electrically connected to the shift control device 341, and outputs an output signal OUT to the corresponding scan line according to the control signal CS, a first trigger signal TS3 and a second trigger signal TS4. Herein, the first and second trigger signals TS3 and TS4 are the clock signals generated by the clock generator (not shown), and the output signal OUT is the scan signal of the scan line corresponding to the driving unit 34. Moreover, the output signal OUT also can be used as the starting signal SS of the next stage of driving unit 34. Thereby, the driving units 34 of the scan driving circuit 33 can sequentially output the output signals OUT to enable the scan lines $S_{31}$~$S_{3m}$. For the first stage of driving unit, the starting signal SS can be the vertical synchronization signal outputted by the timing control circuit. The release device 344 is electrically connected to the driving device 342, and can be controlled by a release signal RS to release the electric energy of the control signal CS or output signal OUT. The first trigger signal TS3 and the second trigger signal TS4 both have no pulse signal within the blanking time Tb of the display panel 31, and that is, they are not continuous signals.

In this embodiment, as shown in FIG. 6B, the driving device 342 includes a first transistor T1. The control terminal of the first transistor T1 is electrically connected to the shift control device 341, the first terminal thereof is used to receive the second trigger signal TS4, and the second terminal thereof outputs the output signal OUT. The release device 344 includes a third transistor T3. The control terminal (gate) of the third transistor T3 receives the release signal RS, the first terminal thereof is electrically connected to the control terminal of the first transistor T1, and the second terminal thereof is electrically connected to the reference voltage (low level voltage $V_{GL}$).

The driving unit 34 further includes a pull-down device 343, which is electrically connected to the shift control device 341 and the driving device 342. Herein, the pull-down device 343 includes a second transistor T2. The control terminal (gate) of the second transistor T2 is electrically connected to the shift control device 341, the first terminal thereof is electrically connected to the second terminal of the first transistor T1, and the second terminal thereof is electrically connected to a reference voltage (low level voltage $V_{GL}$). Besides, the driving unit 34 can further include a capacitance C. The first terminal of the capacitance C is electrically connected to the control terminal of the first transistor T1, and the second terminal of the capacitance C is electrically connected to the second terminal of the first transistor T1 and the first terminal of the second transistor T2. Since other technical features of the driving unit 34 can be comprehended by referring to the driving unit 24*a* of the first embodiment, they are not described here for conciseness.

Figures 7A, 7B, 7C:
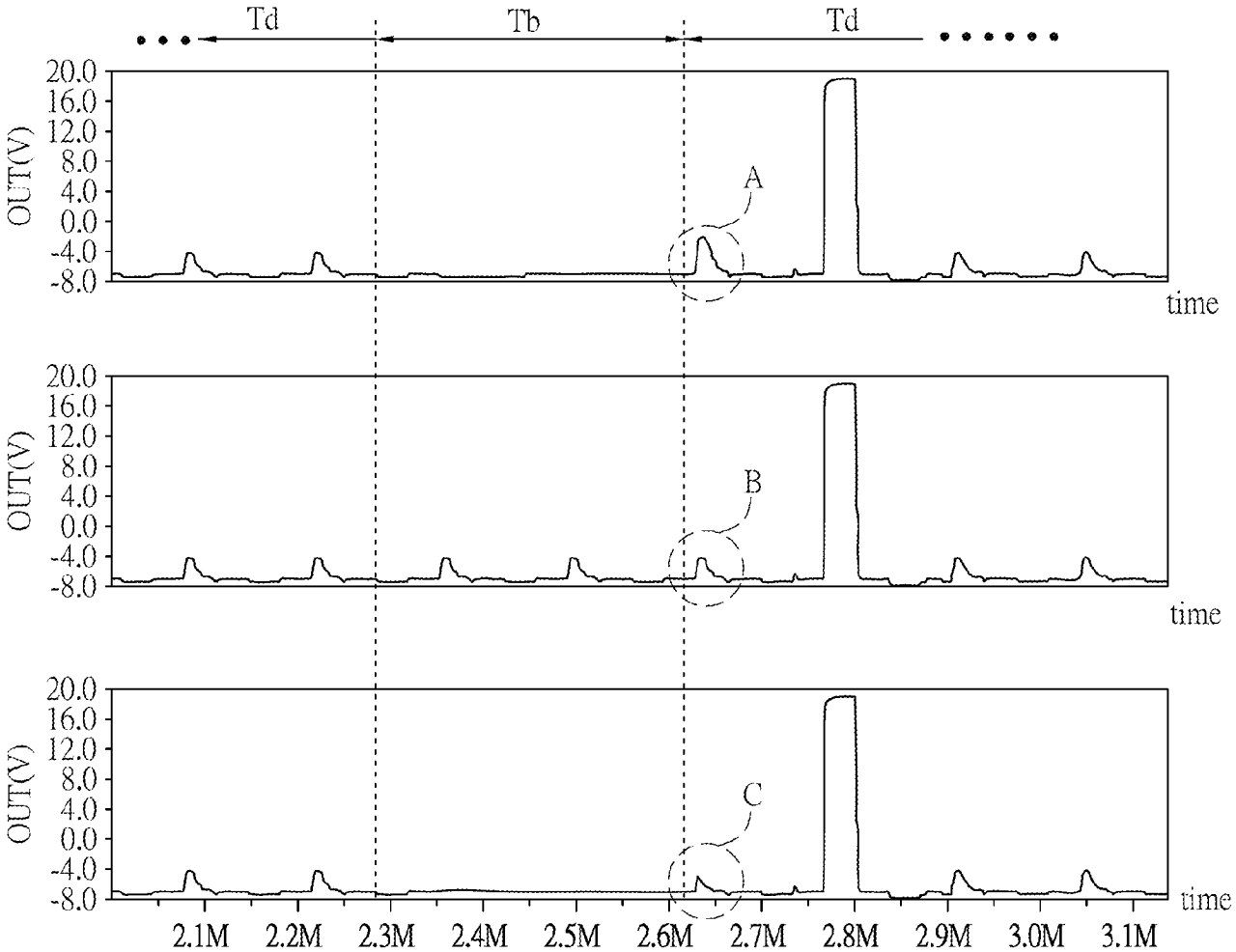
FIG.7A (Prior Art)
FIG. 7A is a schematic waveform diagram of the output signal of the driving unit of the scan driving circuit in the conventional art.
FIG. 7B is a schematic waveform diagram of the output signal of the driving unit of the first embodiment of the invention.
FIG. 7C is a schematic waveform diagram of the output signal of the driving unit of the second embodiment of the invention.

FIG. 7A is a schematic waveform diagram of the output signal (scan signal) of the driving unit of the scan driving circuit in the conventional art, FIG. 7B is a schematic waveform diagram of the output signal of the driving unit of the first embodiment of the invention, and FIG. 7C is a schematic waveform diagram of the output signal of the driving unit of the second embodiment of the invention.

As shown in FIG. 7A, in the conventional art, the output signal OUT has a high-level ripple in a beginning region A of the data output time Td, and the practical voltage value of the ripple is about 4.7V. However, in the first embodiment of FIG. 7B and second embodiment of FIG. 7C, the output signal OUT has no high-level ripple in the beginning regions B and C of the data output time Td. Therefore, the display apparatus of this invention certainly can avoid the current leakage of the pixel voltage caused by the ripple and thus avoid erroneous display (e.g. with bright or dark lines).

In summary, in the display apparatus of the invention, within the first pulse of the second trigger signal after the data output time of the display panel begins and within the blanking time of the display panel, the rising transition time of the second trigger signal overlaps the falling transition time of the first trigger signal, or the release device is controlled by the release signal to release the electric energy of the control signal or output signal. Thereby, within the beginning and blanking time of the frame time of every image, the high-level noise of the second trigger signal caused by coupling and current leakage effects can be eliminated. Or, the release device is turned on by the release signal to release the high-level ripple noise of the control signal (inputted to the driving device) or output signal. Therefore, the voltage difference between the gate and source of the driving transistor on the display panel will not be greater than the threshold voltage of the driving transistor so that the display apparatus can avoid the current leakage problem of the pixel voltage and thus avoid erroneous display (e.g. with bright or dark lines).

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A display apparatus, comprising:

a display panel;

a data driving circuit electrically connected to the display panel through a plurality of data lines; and a scan driving circuit electrically connected to the display panel through a plurality of scan lines and including a plurality of stages of driving unit, which are respectively corresponding to the scan lines, wherein the driving unit comprises:

a shift control device outputting a control signal according to a starting signal; and a driving device electrically connected to the shift control device and outputting an output signal to the corresponding scan line according to the control signal, a first trigger signal and a second trigger signal, wherein the output signal is used as the starting signal of the next stage of driving unit, and the rising transition time of the, second trigger signal and the falling transition time of the first trigger signal have an overlap.

2. The display apparatus as recited in claim 1, wherein the driving device includes a first transistor, the control terminal of the first transistor is electrically connected to the shift control device, the first terminal thereof is used to receive the second trigger signal, and the second terminal thereof outputs the output signal.

3. The display apparatus as recited in claim 2, wherein each stage of driving unit further includes a pull-down device, which is electrically connected to the shift control device and the driving device.

4. The display apparatus as recited in claim 3, wherein the pull-down device includes a second transistor, the control terminal of the second transistor is electrically connected to the shift control device, the first terminal thereof is electrically connected to the second terminal of the first transistor, and the second terminal thereof is electrically connected to a reference voltage.

5. The display apparatus as recited in claim 4, wherein each stage of driving unit further includes a release device, which is electrically connected to the driving device and controlled by a release signal to release the electric energy of the control signal or output signal.

6. The display apparatus as recited in claim 5, wherein the release device includes a third transistor, the control terminal of the third transistor receives the release signal, the first terminal thereof is electrically connected to the control terminal of the first transistor, and the second terminal thereof is electrically connected to the reference voltage.

7. The display apparatus as recited in claim 1, further comprising:

a clock generator electrically connected to every stage of driving unit and generating a plurality of clock signals, and including a first clock signal as the first trigger signal and a second clock signal as the second trigger signal.

8. A display apparatus, comprising:

a display panel;

a data driving circuit electrically connected to the display panel through a plurality of data lines; and a scan driving circuit electrically connected to the display panel through a plurality of scan lines and including a plurality of stages of driving unit, which are respectively corresponding to the scan lines, wherein the driving unit comprises:

a shift control device outputting a control signal according to a starting signal;

a driving device electrically connected to the shift control device and outputting an output signal to the corresponding scan line according to the control signal, a first trigger signal and a second trigger signal; and a release device electrically connected to the driving device and controlled by a release signal to release the electric energy of the control signal or output signal.

9. The display apparatus as recited in claim 8, wherein the driving device includes a first transistor, the control terminal of the first transistor is electrically connected to the shift control device, the first terminal thereof is used to receive the second trigger signal, and the second terminal thereof outputs the output signal.

10. The display apparatus as recited in claim 9, wherein each stage of driving unit further includes a pull-down device, which is electrically connected to the shift control device and the driving device.

11. The display apparatus as recited in claim 10, wherein the pull-down device includes a second transistor, the control terminal of the second transistor is electrically connected to the shift control device, the first terminal thereof is electrically connected to the second terminal of the first transistor, and the second terminal thereof is electrically connected to a reference voltage.

12. The display apparatus as recited in claim 11, wherein the release device includes a third transistor, the control terminal of the third transistor receives the release signal, the first terminal thereof is electrically connected to the control terminal of the first transistor, and the second terminal thereof is electrically connected to the reference voltage.

13. The display apparatus as recited in claim 11, wherein the release device includes a third transistor, the control terminal of the third transistor receives the release signal, the first terminal thereof is electrically connected to the second terminal of the first transistor, and the second terminal thereof is electrically connected to the reference voltage.

* * * * *